US007942755B2

(12) United States Patent
Diley

(10) Patent No.: US 7,942,755 B2
(45) Date of Patent: May 17, 2011

(54) CORE CONNECTOR PUTTING STROKE TRAINER

(75) Inventor: Mark J Diley, Boyds, MD (US)

(73) Assignee: Mark J. Diley, Boyds, MD (US)

( * ) Notice: Subject to any disclaimer, the term of this patent is extended or adjusted under 35 U.S.C. 154(b) by 0 days.

(21) Appl. No.: 12/321,924

(22) Filed: Jan. 28, 2009

(65) Prior Publication Data

US 2010/0190565 A1 Jul. 29, 2010

(51) Int. Cl.
*A63B 69/36* (2006.01)

(52) U.S. Cl. ..... 473/227; 473/215; 473/277

(58) Field of Classification Search ..... 473/207, 473/215, 219, 226, 227, 266, 277
See application file for complete search history.

(56) References Cited

U.S. PATENT DOCUMENTS

| | | | | |
|---|---|---|---|---|
| 4,509,757 | A * | 4/1985 | Yuhara | 473/215 |
| 5,150,901 | A * | 9/1992 | Stawicki | 473/215 |
| 5,156,401 | A * | 10/1992 | Hodgkiss | 473/227 |
| 5,413,329 | A * | 5/1995 | Hirsch | 473/238 |
| 5,531,446 | A * | 7/1996 | Scheie et al. | 473/227 |
| 6,358,156 | B1 * | 3/2002 | Moran | 473/219 |

* cited by examiner

*Primary Examiner* — Nini Legesse
(74) *Attorney, Agent, or Firm* — Nick Aquilino

(57) ABSTRACT

A golf training apparatus is used in combination with a golf putter to train a golfer to execute a putting stroke keeping the golfer's core in the same relative position to the golfer's hands. The apparatus includes a parabolic shaped yoke member having an arcuate inner edge for engagement across the lower torso of a golfer. An adjustable length connector member connects the yoke member to the golf putter.

5 Claims, 2 Drawing Sheets

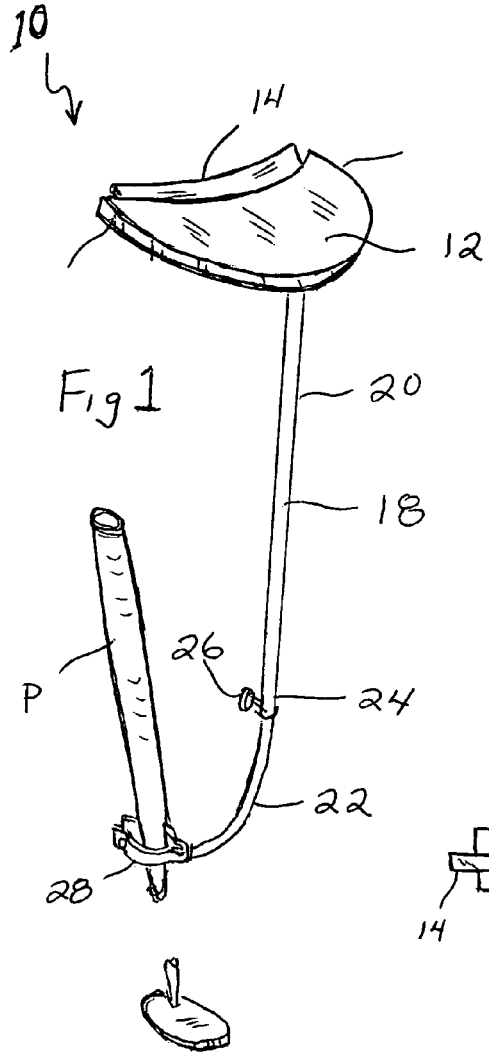
Fig 1
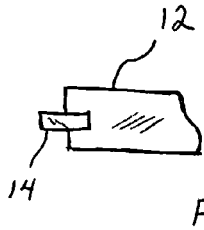
Fig 2
Fig 5
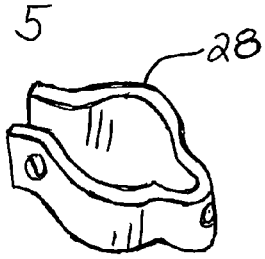
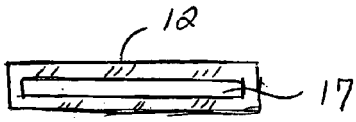
Fig 3
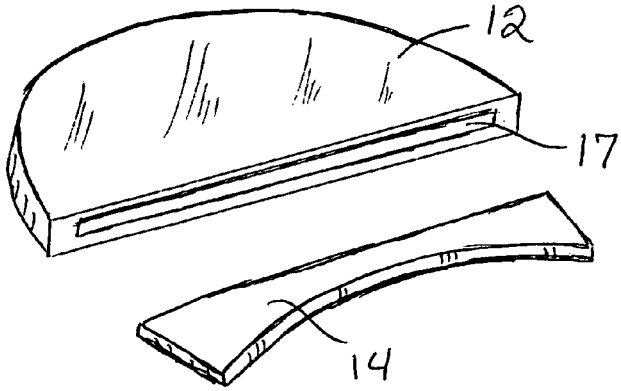
Fig 4

CORE CONNECTOR PUTTING STROKE TRAINER

The present invention relates to a golf training device and in particular to a device to improve a golfer's putting stroke.

Modern putting strokes minimize movement of the hands and arms during the execution of a putting stroke to insure the path of the putter head maintains a straight line to the target, to maintain the putter face at a constant angle and to insure the golf ball is struck precisely on the face to impart the desired energy to the golf ball. Ideally to achieve these results, a golfer will train in order that the mechanics of the putting stroke become repeatable and consistent for each putt.

Various training devices have been developed in an attempt to achieve a precise and repeatable putting stroke. However the prior art is silent with respect to training devices that train a golfer to make a consistent putting stroke using the core portion of the golfer's body.

The following patents are examples of devices representing the known state of the art.

U.S. Pat. No. 7,033,282 to Flood relates to a putting training device having a transverse member that engages a user's biceps and an adjustable, descending shaft that connects with the top of the putter grip. The device encourages the correct position of the golfer's arms, wrists and hands relative to the putter during a putting stroke.

U.S. Pat. No. 6,358,156 to Moran shows a training device to attach to the grip end of the club and to engage the arms of the golfer.

U.S. Pat. No. 5,156,401 to Hodgkiss relates to a t-shaped putting trainer including a lower end that is secured to the putter handle and an upper bar extending behind the users arms.

U.S. Pat. No. 7,033,284 to Yoshimura shows a training device that engages the arms of the golfer and adjusts the distance between the arms and includes a lower member that attaches to the handle of the club.

U.S. Pat. No. 6,251,025 to Brock et al relates to a golfing aid that attaches to the handle of the club and includes a guide that engages the wrist during a full swing golf shot.

U.S. Pat. No. 5,342,055 to Diley, the present inventor, discloses a training device for a putter including an elongated shaft connected to the putter head having an upper neck engaging loop to train the golfer to make consistent putting strokes.

All of the above patents are directed to training devices and apparatus for controlling the golfer's arms and hands during the execution of a putting stroke. The present invention is directed to a golf putting trainer to teach a golfer to make consistent putting strokes using the core portion of his body in order to completely eliminate the hands and arms during the putting stroke. The device is formed with a first lower elongated, member, adjustable in length that is attached to the handle portion of the club head and a second upper arcuate, yoke shaped member that is shaped to engage the torso or core portion of the golfer's body. In use, with the device attached to the putter handle, the arcuate member is placed lightly against the front of the lower torso of the golfer.

During the execution of a putting stroke, the golfer trains his movements in such a way to maintain constant pressure against the torso with the inner edge of the arcuate member. When the putting stroke is properly executed, equal pressure is applied along the length of the arcuate member. This insures the golfer's torso moves with the movement of the golfer's arms and the putter. If excess pressure is experienced along the length of the arcuate member that is greater than other portions of the arcuate member, for example at either end thereof, or if a portion along the length of the arcuate member separates from the golfer's torso, this provides an indication that the torso is not connected properly relative to the golfer's arms and the putter as it is swung during the stroke.

If the entire edge of the arcuate portion of the device is maintained at a constant pressure against the golfer's core, this indicates the core portion of the golfer's body is moving in synchronism with the hands, arms and putter. This results in the club head following a repeatable path while maintaining the club face square during the execution of a putting stroke. Constant repetition using the training apparatus creates a consistent putting stroke for playing the game of golf.

Among the objects of the present invention is the provision of a training device to teach a golfer to keep the core portion of the player's body connected to the hands, arms and putter during a putting stroke.

Another object of the present invention is the provision of a training device that provides tactile feedback when the player's arms become disconnected from the player's core during a putting stroke.

Still another object of the present invention is the provision of a training device to train a golfer to use the larger parts of the body while eliminating use of the hands and arms during a putting stroke.

These and other objects will become apparent from the following specification and accompanying drawings.

DESCRIPTION OF THE DRAWINGS

FIG. 1 is a perspective view of the golf training device of the present invention.

FIG. 2 is a partial cross-sectional view of a detail of the device of FIG. 1.

FIG. 3 is an elevational view of a detail of the device of FIG. 1.

FIG. 4 is an exploded top plan view of a detail of FIG. 1.

FIG. 5 is a view of another detail of the device of FIG. 1.

DESCRIPTION OF THE PREFERRED EMBODIMENT

Figure 6:
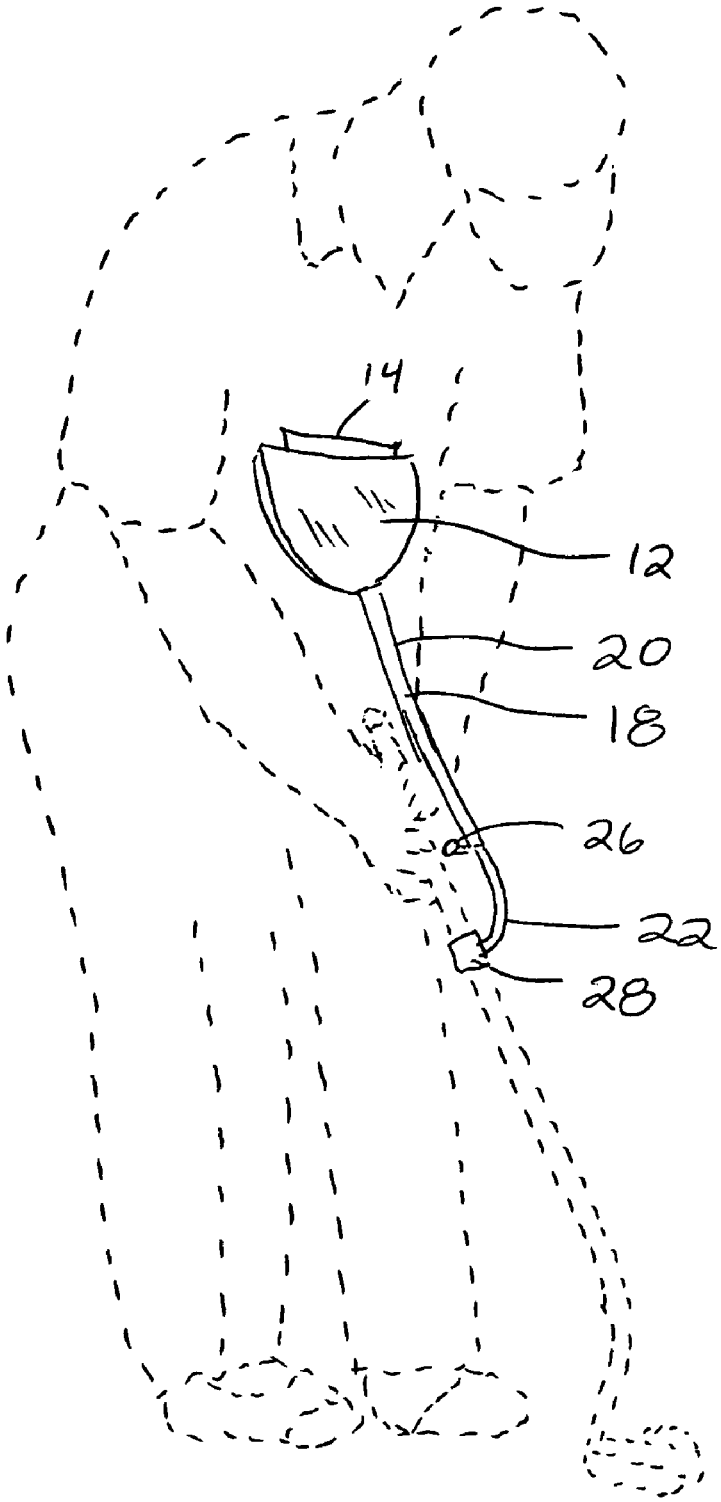
FIG. 6 is a perspective view of the device attached to a putter as it is used with a golfer shown in phantom lines.

The preferred embodiment of the present invention is disclosed herein, however, it is to be understood that the disclosure is exemplary of various embodiments of the invention and these details are not to be interpreted as limiting. They merely serve as a basis for the claims and for teaching one skilled in the art how to make and/or use the training device.

The training device of the present invention enables a golfer to learn and practice a repetitive putting stroke wherein the golfer's hands, arms and putter remain connected to the core portion of the body at the torso thus eliminating excessive use of the hands and arms to create a swing path movement of the putter head synchronized to the movement of the core portion of the golfer's body.

Referring to the drawings, the golf training device 10 is formed of a generally parabolic shaped yoke member 12 having a core engaging, arcuate inner edge member 14 sized to extend from one side of the golfer's lower torso to the opposite side of the torso. The yoke member 12 is defined by a center section 15 and ends 16. An elongated, two-piece, connector rod 18 attaches the torso engaging yoke member 12 to a putter P. A first, straight upper piece 20 of the connector rod 18 is attached to a frontal portion of the center section 15 of the yoke member 12 approximately midway between ends 16 of the yoke member 12 and extends downwardly therefrom. The second piece 22 of the connector rod 18 is curved inwardly in order to connect to the grip of the putter P. Preferably first and second pieces 20 and 22 of the connector rod are formed of two telescoping cylindrical members such that the second curved piece 22 telescopes into the first piece 20. This enables the connector rod 18 to be adjustable in length in order to accommodate golfers having different physical characteristics, sizes and shapes. A connector joint 24 having a threaded screw pin 26 secures the lower second piece 22 within the first upper piece 20 at a preselected location to accommodate the size of the golfer. The lower piece 22 of the connector rod 18 includes a clamp 28 that attaches to the handle of a golf putter P.

In this preferred embodiment, the inner edge member 14 of the parabolic shaped yoke member 12 is formed as a separate, removable member that fits into a slot 17 in the yoke member 12. This allows the core engaging, inner edge member 14 to be formed in various shapes to accommodate different sized and shaped torsos of golfers. It will be appreciated that the core engaging member 14 may be permanently formed as part of the yoke member 12 so that one size fits all sized golfers.

In use, the club connector rod 18 is secured to the handle of the putter P so that the parabolic shaped yoke member 12 is positioned so the arcuate inner edge lightly touches the golfer's torso when the putter is held in a normal address position with the putter head behind the golf ball just prior to the execution of a putting stroke. During the stroke, the inner edge 14 of the parabolic shaped yoke member 12 remains connected to the golfer's torso when the stroke is properly executed. Should the golfer only use the hands or arms in making the stroke, one or both of the ends 16 of the yoke member 12 will release from the golfer's torso providing a visual and tactile indication the arms and putter are no longer in the same position relative to the golfer's core.

For example, if a golfer executes a putting stroke where the hands extend away from the body during the backstroke, one end 16 of the yoke member 12 will separate from the golfer's core. Alternately should the golfer's hands extend toward the golfer's body, the opposite end 16 of the yoke member 12 will separate from the golfer's core. Similarly, during the forward swing of the hands extend away from the golfer's body, an end 16 of the yoke member 12 in the same direction as the forward stroke will separate. Likewise during a forward stroke if the hands move toward the golfer's body the opposite trailing end 16 of the yoke member 12 will separate.

Therefore it can be seen that the invention is designed to provide an indication to the golfer both visually and tactically any time the hands move relative to the original desired position relative to the golfer's core. The apparatus is designed for use with both right and left handed golfers since it is symmetrical on both sides.

It will be appreciated that various modifications may be made to the structure of the training device without departing from the spirit and scope of the invention. For example the core engaging member may take a variety of shapes as long as engagement and disengagement from the golfer's core is recognized. Also a variety of adjustable connection members and attachment means may be used. These and other modifications are limited only by the following claims.

The invention claimed is:

1. An apparatus in combination with a golf putter to train a golfer to execute a putting stroke keeping the golfer's core in the same relative position to the golfer's hands comprising:

a lower torso engaging means characterized by a shaped yoke having an arcuate inner edge for engaging a golfer's lower torso across the width thereof from the right side of the torso to the left side of the torso;

said arcuate inner edge being interchangeably removable from said shaped yoke and adjustable in shape; and, a connector member having an upper portion connected to said lower torso engaging means and a lower portion connected to said golf putter.

2. The apparatus of claim 1 wherein said arcuate inner edge is a separate member formed in various shapes to accommodate different sized and shaped torsos of golfers.

3. The apparatus of claim 2 wherein said shaped yoke includes a slot for said arcuate inner edge member.

4. The apparatus of claim 1 wherein said connector member is connected to said lower torso engaging means midway on said shaped yoke.

5. The apparatus of claim 1 wherein said connector member includes an attachment member on said lower portion thereof to secure said apparatus to said putter during use thereof.

* * * * *